US006550789B2

(12) United States Patent
Gaster

(10) Patent No.: US 6,550,789 B2
(45) **Date of Patent: *Apr. 22, 2003**

(54) DETACHABLE IN-LINE SKATE CONVERSION APPARATUS

(76) Inventor: Richard S. Gaster, 13460 Firth Dr., Beverly Hills, CA (US) 90210

( * ) Notice: Subject to any disclaimer, the term of this patent is extended or adjusted under 35 U.S.C. 154(b) by 0 days.

This patent is subject to a terminal disclaimer.

(21) Appl. No.: 09/821,542

(22) Filed: Mar. 28, 2001

(65) Prior Publication Data

US 2001/0020772 A1 Sep. 13, 2001

Related U.S. Application Data

(63) Continuation of application No. 09/106,979, filed on Jun. 29, 1998, now Pat. No. 6,217,037, which is a continuation-in-part of application No. 08/480,011, filed on Jun. 7, 1995, now Pat. No. 5,772,220.

(51) Int. Cl.[7] ..... A63C 17/04

(52) U.S. Cl. ..... 280/11.221; 280/11.26; 280/7.11; 280/811; 280/816; 280/826

(58) Field of Search ..... 980/825, 811, 980/809, 7.1, 7.13, 10, 11.22, 11.23, 816, 826, 7.11, 11.26

(56) References Cited

U.S. PATENT DOCUMENTS

| | | | | |
|---|---|---|---|---|
| 199,664 A | | 1/1878 | Robinson | |
| 988,533 A | | 4/1911 | Zverina | |
| 2,035,897 A | | 3/1936 | Kosanovich | |
| 2,148,687 A | * | 2/1939 | English | 280/11.22 |
| 2,581,809 A | * | 1/1952 | Murray | |
| 3,351,353 A | | 11/1967 | Weitzner | |
| 3,387,852 A | | 6/1968 | De Sarro | |
| 3,979,842 A | | 9/1976 | Texidor | |
| 4,114,295 A | | 9/1978 | Schaefer | |
| 4,273,345 A | | 6/1981 | Ben-Dor | |
| 4,333,249 A | | 6/1982 | Schaefer | |
| 4,526,389 A | | 7/1985 | Chase | |
| 4,869,351 A | | 9/1989 | Romano | |
| 4,988,122 A | | 1/1991 | Saunders | |
| 5,171,032 A | | 12/1992 | Dettmer | |
| 5,183,292 A | | 2/1993 | Ragin, III | |
| 5,224,718 A | | 7/1993 | Gertler | |
| 5,232,231 A | | 8/1993 | Carlsmith | |
| 5,239,941 A | | 8/1993 | Chibi | |
| 5,293,965 A | | 3/1994 | Nagano | |
| 5,303,955 A | | 4/1994 | Zurnamer | |
| 5,320,367 A | | 6/1994 | Landis | |
| 5,340,131 A | | 8/1994 | Smathers | |
| 5,388,844 A | | 2/1995 | Pellegrini, Jr. | |
| 5,398,970 A | | 3/1995 | Tucky | |

(List continued on next page.)

FOREIGN PATENT DOCUMENTS

| | | |
|---|---|---|
| EP | 0 063 104 | 10/1982 |
| EP | 0 183 055 | 6/1986 |
| GB | 3038 A | 2/1909 |
| GB | 2 160 780 A | 1/1986 |
| SE | 195109 | 3/1965 |

*Primary Examiner*—Eric Culbreth
*Assistant Examiner*—Toan C To
(74) *Attorney, Agent, or Firm*—Henricks, Slavin & Holmes LLP

(57) ABSTRACT

At least one walking member is detachably connectable to an in-line skate to enable the wearer of the in-line skate to connect the walking member to the in-line skate, thus enabling the wearer to walk while wearing the in-line skate. Two walking members can be provided on alternative sides of the in-line skate wheels to provide a more stable platform for the wearer of the in-line skate. Since the two walking members are removable, the walking members do not detract from the aerodynamic and functional performance of the in-line skate, and can be manufactured together with the skate or, alternatively, can be added to the skate after purchase.

35 Claims, 9 Drawing Sheets

U.S. PATENT DOCUMENTS 5,400,484 A 3/1995 Gay
5,439,238 A 8/1995 Neal
5,445,415 A 8/1995 Campbell
5,464,235 A 11/1995 Goldman
5,503,433 A 4/1996 Lachapelle
5,505,469 A 4/1996 Zorzi
5,522,621 A * 6/1996 Schneider ..... 280/825
5,527,049 A 6/1996 Ortiz
5,551,711 A 9/1996 Mangelsdorf
5,573,275 A * 11/1996 Smith et al. ..... 280/825
5,580,094 A * 12/1996 Ruehlman et al. ..... 280/825
5,586,777 A 12/1996 Wolf
5,657,999 A 8/1997 Beaulieu
5,664,794 A * 9/1997 Mitchell et al. ..... 280/11.2
5,697,643 A * 12/1997 Marasco ..... 280/825
5,727,796 A 3/1998 Zhang
5,765,841 A * 6/1998 Johnson et al. ..... 280/11.22
5,765,870 A 6/1998 Riley
5,772,220 A 6/1998 Gaster
5,779,245 A 7/1998 Smith
5,785,327 A 7/1998 Gallant
5,791,662 A 8/1998 Searby
5,797,609 A 8/1998 Fichepain
5,803,469 A 9/1998 Yoham
5,820,138 A 10/1998 Sani
5,829,756 A 11/1998 Mitchell
5,833,270 A 11/1998 Hubshman
5,848,808 A 12/1998 Fenton
5,855,381 A 1/1999 Kirk
5,882,018 A 3/1999 Petrosino
5,887,989 A 3/1999 Petrosino
5,890,722 A 4/1999 Smith
5,906,380 A 5/1999 Searby
5,934,693 A * 8/1999 Nicoletti ..... 280/11.22
5,951,049 A 9/1999 Calverley
5,961,130 A 10/1999 Gorza
6,042,125 A 3/2000 Wu
6,047,973 A 4/2000 Amore
6,079,747 A 6/2000 Winsor
6,217,037 B1 4/2001 Gaster
6,279,922 B1 8/2001 Gaster
6,446,982 B1 9/2002 Gaster et al.
6,446,983 B1 9/2002 Gaster

* cited by examiner

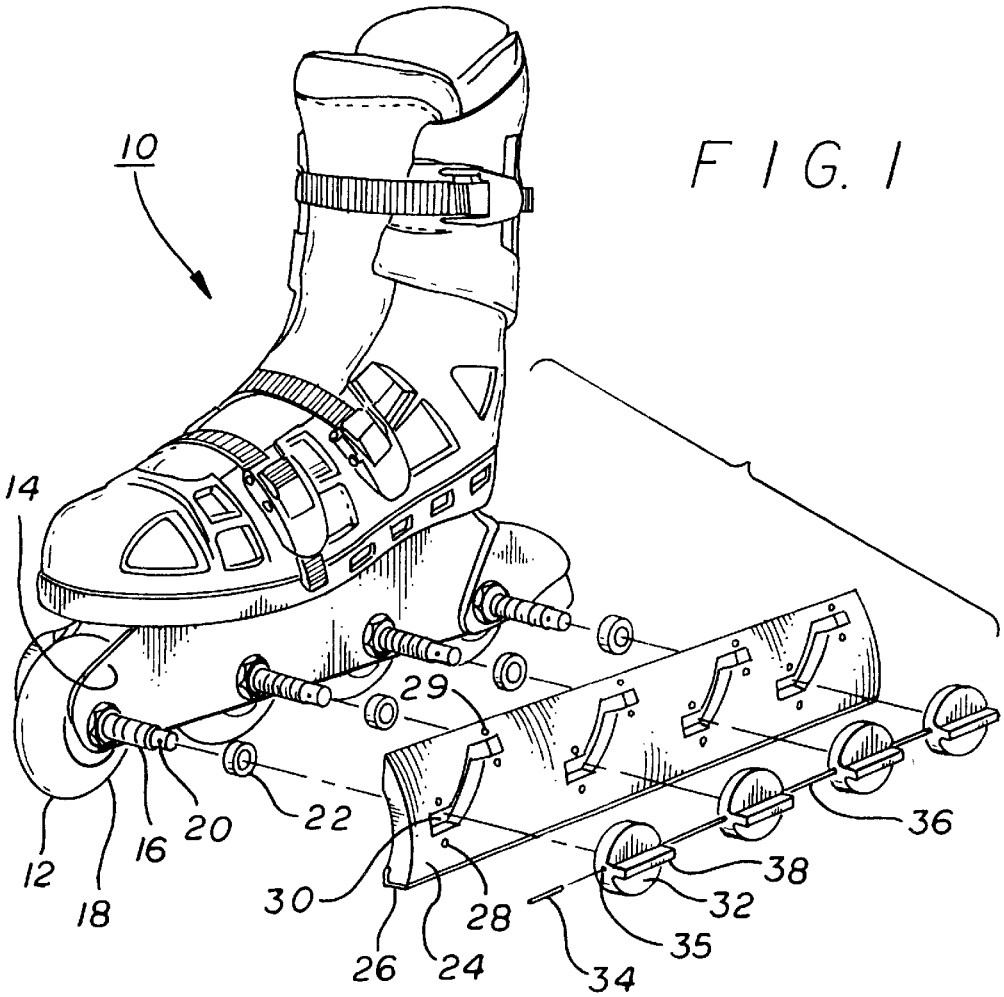
FIG. 1
FIG. 2
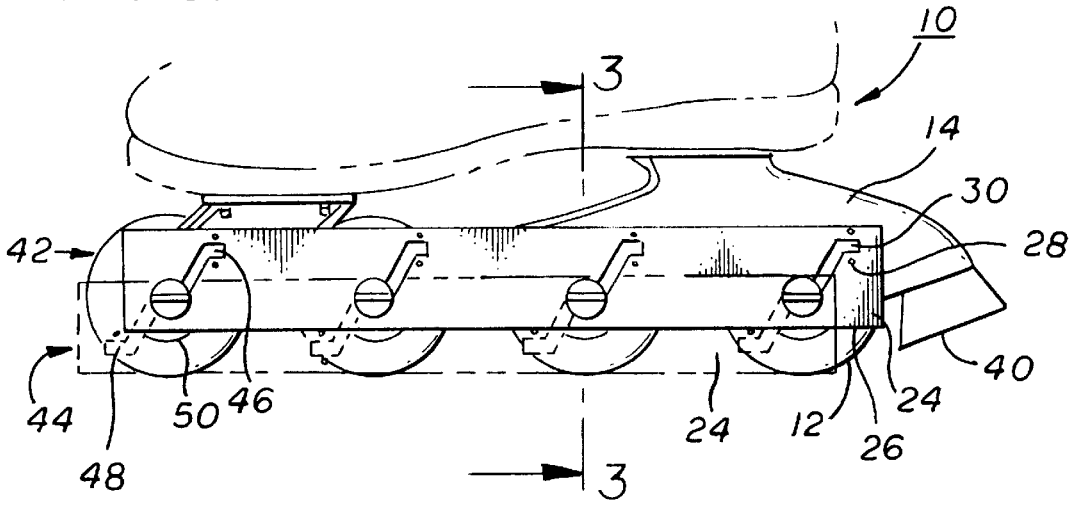

DETACHABLE IN-LINE SKATE CONVERSION APPARATUS

RELATED APPLICATION

The present application is a continuation of U.S. application Ser. No. 09/106,979, filed Jun. 29, 1998, now U.S. Pat. No. 6,217,037, which is itself a continuation-in-part of U.S. application Ser. No. 08/480,011, filed Jun. 7, 1995, now U.S. Pat. No. 5,772,220.

FIELD OF THE INVENTION

The present invention is directed to an in-line skate conversion apparatus. More particularly, the present invention is directed to an apparatus that may be detachably coupled to an in-line skate to enable the wearer of the in-line skate to walk in the skate without fear of falling because of slipping due to the wheels of the skate.

BACKGROUND OF THE INVENTION

In-line skating has exploded in popularity over the last several years. Indeed, in-line skates have replaced roller skates in popularity. One of the reasons for the surge in popularity of in-line skating may be due to the wide variety of equipment available and the lack of a requirement that in-line skating be performed in any particular place. That is, unlike ice skating which requires an individual to go to an ice rink, or roller skating which has traditionally be enjoyed in roller skating rinks, in-line skates are specifically manufactured for use in the outdoors, provided there is a suitable hard surface to skate on. Furthermore, due to the relatively low cost of beginning participation in the sport—which typically requires the purchase of the skates and optional padding for elbows, knees and wrists—in-line skating is economically feasible for most people. As in-line skating has developed, several problems have arisen.

In particular, novice in-line skaters often time have difficulty braking or otherwise slowing themselves down after building up speed. One of the difficulties with braking in in-line skates is the requirements that pressure be placed on a brake pad located substantially rearward of the heel of the wearer. Many skaters have complained that the application of pressure in a downward fashion at the heel by raising the toe is an unnatural motion which requires coordination. Many skaters often time lose balance and fall when attempting to brake in this fashion. To solve the problem with braking in in-line skates, numerous individuals have attempted to offer different braking solutions. For example, U.S. Pat. No. 5,320,367 to Landis which issued on Jun. 14, 1994, disclosed a braking apparatus which utilizes a hand-held brake control for causing the application of rubber brake pads to the wheels of the in-line skate to slow the wearer down. In addition, major in-line skate manufacturers such as Rollerblade have proposed alternative braking mechanisms to assist the wearer in the braking operation.

After the wearer has stopped, however, the wearer must still be able to maneuver on the in-line skates. This has lead to another problem in that once an in-line skater has stopped, in order to move in any direction, the wearer of the skates must roll to the next location. This can often make it quite awkward for a novice in-line skater to, for example, stop at an outdoor snack bar to have lunch. After ordering the food from the window, the skater must carry the food from the window to, for example, a nearby table. The act of carrying the food from the window to the nearby table can represent a terrifying journey for a novice in-line skater. Indeed, the inventor of the instant application had food splattered on him because his mother was unable to stop on her in-line skates while she was carrying food from an outdoor snack bar to the table.

In addition to the above-described '367 patent, U.S. Pat. No. 4,273,345 to Ben-Dor et al. provides a friction plate for the wearer of the skate to drag along the ground to stop the movement of the skate. U.S. Pat. No. 3,351,353 to D. M. Weitzner discloses a pair of retractable roller and ice skates for shoes. As seen in FIGS. 10 and 13 of the '353 patent, the shoe can be taken apart so that a plate 50 is removed from its channel, inverted, and then reinserted into the channel 40 above the roller assemblies. The plate is thus stored out of the way in the channel and at the same time serves as a spacer and bearing member holding the roller assembly 70 in a stable position in the sole of the shoe, thus enabling the shoe to serve as a roller skate. While the device enables a shoe to be worn as a roller skate, it requires the shoe to be disassembled and reassembled prior to wearing the roller portion of the shoe.

Similarly, U.S. Pat. No. 3,979,842 to Texidor discloses an athletic shoe exerciser which retains rollers when they are not being used in a lower portion of the exerciser. Specifically, as seen in FIG. 2, the roller skates are folded up into the base 14 of the shoe when not in use. Other modifications are sports shoes are also known. For example, U.S. Pat. No. 4,114,295 to Schaefer discloses a convertible sports shoe which may be converted from a roller skate to an ice skate. Similarly, U.S. Pat. No. 3,387,852 discloses roller skates which can be removed from the bottom of the shoe 20. U.S. Pat. No. 5,224,718 to Gertler discloses a foot transport device which can be fastened to a standard walking shoe. Finally, U.S. Pat. No. 4,988,122 discloses a combination roller skate and ice skate which includes a boot which can have a roller portion or an ice skate portion attached thereto.

The inventor has found a need for a conversion apparatus which would enable the wearer of standard in-line skates to walk on the skates without activating the wheels thereof. Furthermore, such a device would have to be cost effective, rugged and simple to use while not requiring the wearer to take the skates off their feet. Furthermore, such a device must be usable with a wide variety of in-line skates, including in-line skates having 3, 4 or more wheels. The device must be aerodynamically acceptable to advanced in-line skaters as well as practical for novices to utilize.

SUMMARY OF THE INVENTION

The present invention solves the above and other problems associated with the prior art while providing for an economically efficient apparatus for converting a standard in-line skate to a walking shoe without sacrificing the performance characteristics of the in-line skate.

More particularly, the present invention provides for a cost effective solution to the problem of converting an in-line skate to a walking shoe by providing at least one walking member which extends from a wheel support plate in a downward direction to a position equal to or beyond the range of the wheels. When the walking member is extended, the in-line skate is converted to a relatively stable walking platform to enable the wearer to maneuver in relative safety. Thus, for example, with the walking members in the down position, the wearer would be able to walk from an outdoor snack counter without having to worry about the ability to stop once she arrived at the table. In this fashion, she could avoid spilling food and drinks on her children by maintaining control at all times.

Similarly, the present invention will enable the wearer of in-line skates to skate from, for example, from their home to a place of business such as a store, and then convert the skate to a walking shoe to allow the individual to enter the premises. After the user has conducted their business in the premises, he can leave the business, reconvert the skates to standard in-line skates by removing or raising the walking members, and then continue on his way using the in-line skates in the normal fashion.

The apparatus of the present invention provides for the conversion of in-line skates to walking shoes while maintaining the aerodynamic and performance qualities of the in-line skates such that the device will be acceptable to both advanced as well as novice in-line skaters. Furthermore, the device of the present invention may be adapted to presently existing in-line skates through the use of simple conversion hardware. It is economical to install and cost effective to manufacture.

In another embodiment of the present invention, a pair of detachable walking members is provided which allows the wearer to selectively decouple the walking members and entirely remove them from the in-line skate, only engaging the walking members with the skate when they are needed to walk. Thus, those users of in-line skates who do not prefer to have a walking member permanently coupled with the skate may utilize the detachable walking members. For convenience, the pair of detachable walking members may be connected via a flexible member.

The above and other embodiments and features of the present invention will be better understood through a reading of the detailed description of the present invention when taken in conjunction with the drawings. It should be understood that the following description and drawings are in no way intended to limit the present invention which is best defined by the claims appended hereto.

BRIEF DESCRIPTION OF THE DRAWINGS

FIG. 1 is an exploded perspective view of an in-line skate incorporating one embodiment of the present invention.

FIG. 2 is a partial side view of the in-line skate seen in FIG. 1 illustrating the operation of one embodiment of the present invention.

DETAILED DESCRIPTION OF THE PREFERRED EMBODIMENTS

Figure 3:
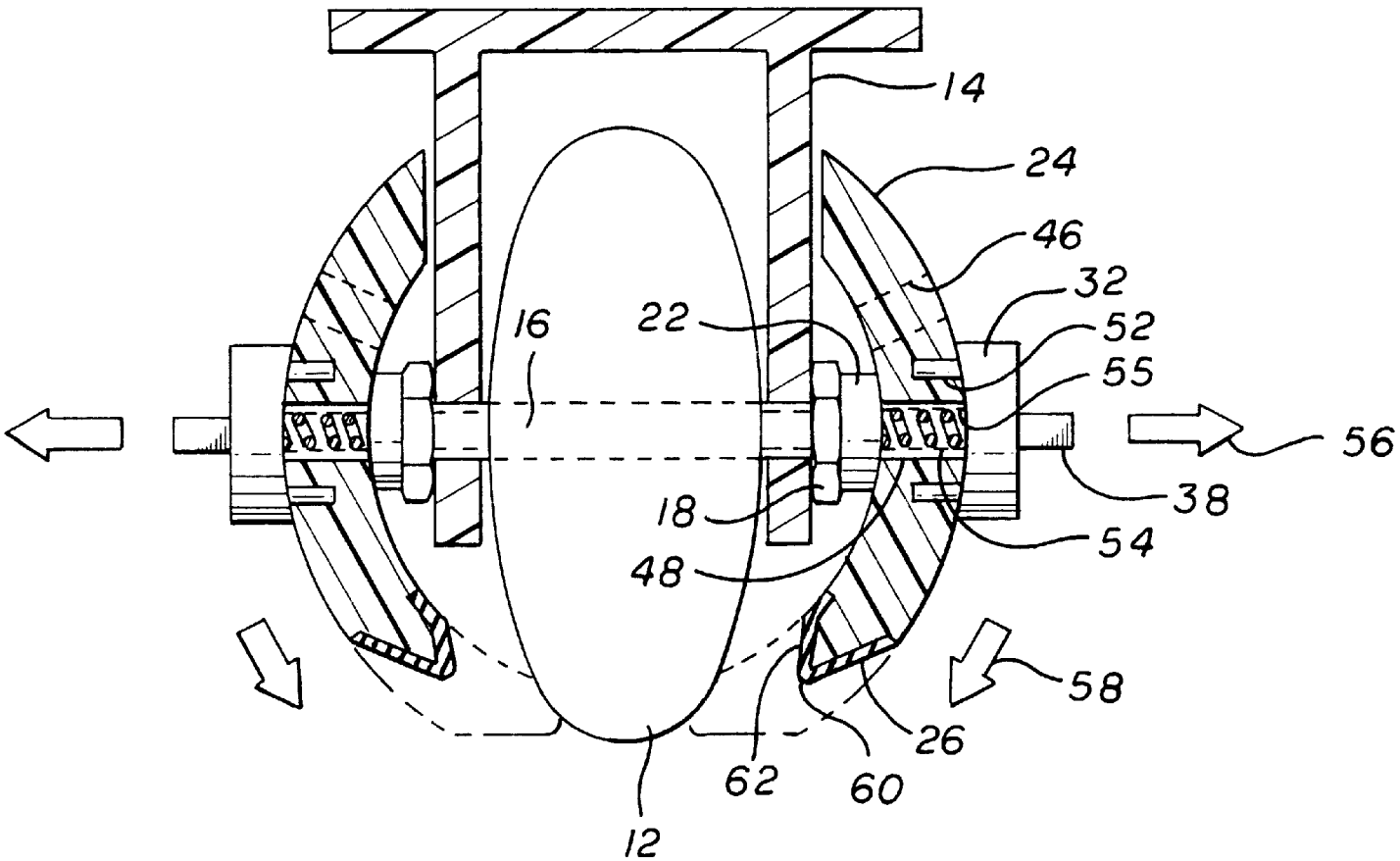
FIG. 3 is a cross-sectional view of a portion of the in-line skate of FIG. 2 taken along the lines 3—3 of FIG. 2.

FIGS. 1–6 illustrate the preferred embodiments of the present invention. In the following discussion of the presently preferred embodiments, like reference numerals refer to like elements. Further, the following discussion is not to be considered in a limiting sense. Rather, while the following discussion taken in conjunction with the drawings illustrate the presently preferred embodiments of the present invention, the invention is in no way limited to the embodiments described below and shown in the drawings. It is to be understood that numerous modifications, additions and/or substitutions can be made to the preferred embodiments without departing from the spirit and scope of the present invention.

FIGS. 1–3 illustrate a first preferred embodiment of the present invention. An in-line skating boot 10 in accordance with the present invention incorporates a plurality of wheels 12 which are connected to the boot 10 through a pair of wheel support members or plates 14. A plurality of bolts 16 connect the wheels support plates 14, which are connected to the underside of the boot 10, to the wheels 12. A plurality of nuts 18 are used to fasten the bolts 16 in place on the wheel support plates 14. The bolts 16 are threaded at appropriate locations to allow the nuts 18 to be secured thereto. Further, one skilled in the art will recognize that washers may be placed between the nuts 18 and the wheel support plates 14. Likewise, washers may also be used between the wheel support plates 14 and the wheels 12. At this point, it should be understood that while the following description and references to the drawings will be made primarily to a single side of the in-line skating boot 10 incorporating the present invention (e.g., as seen in FIG. 1), the present invention can incorporate similar elements on each side of the wheels 12 as seen in, for example, FIG. 3.

The bolts 16 illustrated in FIG. 1 incorporate a tubular receptacle 20 at locations substantially adjacent to respective ends thereof. Referring more specifically to FIGS. 1 and 3, it is seen that a spacer 22 is fitted over the bolt 16 and rests substantially adjacent to the nut 18. The spacers 22 serve to space a pair of curved walking members 24 from respective side surfaces of the wheel support plates 14. The walking members 24 are formed in an arched fashion and incorporate a rubber strip 26 along a lower ground-facing surface thereof. The walking members 24 incorporate a pair of lower locking holes 28 and pair of upper locking holes 29 at respective ends of a plurality of slide slots 30 through which extends the corresponding plurality of bolts 16. A corresponding number of walking member control knobs 32 are disposed on respective ends of each of the plurality of bolts 16. A knob securing pin 34 is inserted into holes formed in a side surface of the walking member control knobs 32 and is received in the receptacles 20 disposed at respective ends of the bolts 16. The walking member control knobs 32 are provided with a finger grip ridge 38. A connecting rod 36 may be provided to connect each of the respective walking member control knobs 32 so that such knobs may be operated in a simultaneous fashion as described in more detail below.

The general operation of the present invention will be described with reference to FIG. 2. The typical in-line skate boot 10 is provided with a braking pad 40 disposed substantially rearward of the heel of the boot 10 and is attached to the wheel support plates 14. As seen in the figure, the walking member 24 is shown illustrated in two positions: an up position 42 and a down position 44. In order to move the walking member 24 from the up position 42 to the down position 44, the bolts 16 which extend through the walking member 24 by passing through the slide slots 30 must be positionable in an upper bolt rest position 46 or a lower bolt rest position 48. A transitional slot 50 connects the upper bolt rest position 46 with the lower bolt rest position 48. Thus, referring to FIG. 2 specifically, in order for the walking member 24 to be moved from the up position 42 to the down position 44 (the walking member 24 is illustrated by dashed lines in the down position 44), the walking member 24 which is positioned such that the bolt 16, which is positioned at the lower bolt rest position 48, must be changed from the lower bolt rest position 48 via the transitional slot 50 and to the upper bolt rest position 46. Thus, when the bolts 16 are positioned in the upper bolt rest positions 46, the walking member 24 is disposed in the down position 44. Similarly, when the bolts 16 are positioned in the lower bolt rest positions 48, the walking member 24 is disposed in the up position 42. When the walking member 24 is disposed in the down position 44, the rubber strip 26 is preferably disposed at a position substantially level with the lowest position on the wheels 12. Of course the down position of the rubber strip 26 may be determined based on the distance between positions 46, 48.

Referring in more detail to FIG. 3, the transition of the walking member from the up position 42 to the down position 44 as illustrated in more detail. Specifically, it is seen that the walking member control knobs 32 have a pair of locking pins 52 which protrude from an inner surface of the walking member control knobs 32. The locking pins 52 are preferably made of steel or suitably hard materials such as ceramic, in order to support the weight of the wearer. The locking pins 52 are received in the respective lower and upper locking holes 28, 29 seen in FIG. 1. By receiving the locking pins 52 in the respective locking holes 28, 29, the bolts 16 which attach to the walking member control knobs 32 are held in the respective upper and lower bolt rest positions 46, 48. A spring 54 is mounted inside of the bolt 16 and is used to bias the walking member control knobs 32 against the walking members 24. A spring channel 55 is provided within the bolts 16 to contain the spring 54. The spring 54 is preferably of sufficient strength to properly bias the walking member control knobs 32 while still allowing the wearer to be able to overcome the force of the spring 54 to move the walking member control knobs 32 in the direction of the directional arrows 56.

In operation, the control knob 32 is pulled by the wearer in the direction of the outward directional arrow 56 and the walking member 24 is moved by the wearer in the direction of the downward directional arrow 58. The transitional movement of the walking member 24 in the direction of the downward directional arrow 58 is achieved by the movement of walking members 24 relative to the bolts 16 in the transitional slots 50 between the lower bolt rest position 48 and the upper bolt rest position 46. It should be noted that the downward directional arrow 58 is additionally angled in an inward fashion. The arched movement of the walking member 24 as the position of the bolt 16 is changed from the lower bolt rest position 48 to the upper bolt rest position 46 is achieved due to the arcuate structure of the walking member 24. Specifically, the inward arc formation of the walking member 24 moves relative to spacer 22 which causes the ground-side surface 60 of the rubber strip 26 to move inward toward the wheels 12. As can be seen in FIG. 3, the rubber strip 26 is disposed along each side of the tip of the walking member 24. In this fashion, the rubber strip 26 includes a wheel-side surface 62. When the walking member 24 is disposed in the down position 44, as seen in FIG. 2, the wheel-side surface 62 of the rubber strip 26 is disposed substantially adjacent to the wheel 12. In this fashion, when the walking member 24 is in the down position 44, the wheels 12 are prevented from turning due to the frictional contact between the wheel-side surface 62 of the rubber strip 26 and the wheels 12. Of course, the rubber strip 26 may be provided with a tread or knobby bottom surface to assist in traction. The rubber strip 26 is also optional, or could be formed of a different material.

Referring back to FIG. 1, the walking member control knobs 32 may be pulled in an outward direction identified by the outward directional arrow 56, and turned to the prevent the locking pins 52 from remaining engaged in the respective locking holes 28, 29 due to the biasing force of the spring 54. After all of the knobs 32 have been pulled and turned to disengage the respective pins 52, walking member 24 may be slid between the up and down positions 42, 44, as seen in FIG. 2. Alternatively, a connecting rod 36 may be provided between each of the walking member control knobs 32. In this fashion, by pulling on the connecting rod 36, the wearer of the shoe may operate all of the walking member control knobs 32 located on a side of the in-line skate boot 10 simultaneously.

Figure 4:
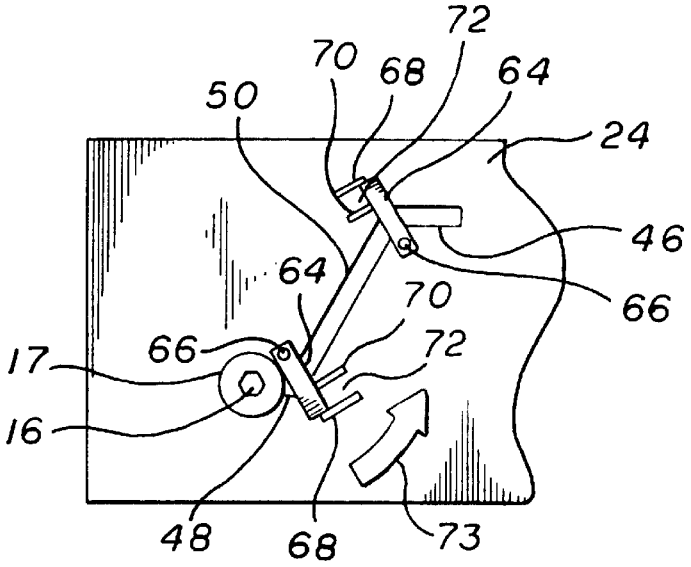
FIG. 4 is a partial side view of an alternative locking arrangement for use with the present invention.

Referring to FIG. 4, an alternative embodiment for a locking mechanism is shown. Specifically, in FIG. 4 the bolts 16 is provided with an optional rounded head 17. A locking arm 64 is disposed at the upper and lower bolt rest positions 46, 48. A pair of channels 68, 70 define a locking tongue 72 which is preferably formed to incline upwardly from the side of the walking member 24. The locking tongue 72 is formed integral with the walking member 24 and is moveable in a direction normal to the plane of FIG. 4. The locking arm 64 pivots in a circular fashion about a pivot pin 66.

In operation, the wearer simply pushes inward on the locking tongue 72 which allows the locking arm 64 to pivot about the pivot pin 66 in a circular fashion, thus releasing the bolt 16 and optional rounded head 17 from the upper or lower bolt rest positions 46, 48. Specifically, to move the walking member 24 such that the bolt 16 and optional rounded head 17 are changed from the lower bolt rest position 48 to the upper bolt rest position 46 seen in FIG. 4, the wearer would push down on the lower locking tongue 72, and pivot the locking arm 64 in the direction of directional arrow 73 about the pivot pin 66. This would allow the position of the bolt 16 and optional rounded head 17 to be changed to the transitional slot 50 and then up towards the upper bolt rest position 46. The upper locking arm 64 can remain in the position illustrated in FIG. 4 and when the bolt 16 and optional rounded head 17 reach the upper location, the upper locking arm 64 would pivot in a position opposite to the directional arrow 73 in circular fashion, thus, allowing the bolt 16 and optional rounded head 17 to enter the upper bolt rest position 46. The upper locking arm 64 would travel in a circular, clockwise fashion and slide over the upper locking tongue 72 (pushing the upper locking tongue in a downward fashion). When the upper locking arm 64 traveled past the upper locking tongue 72, the upper locking tongue 72 is biased so as to spring outward thus holding the upper locking arm 64 in the position illustrated in FIG. 4.

Figure 5:
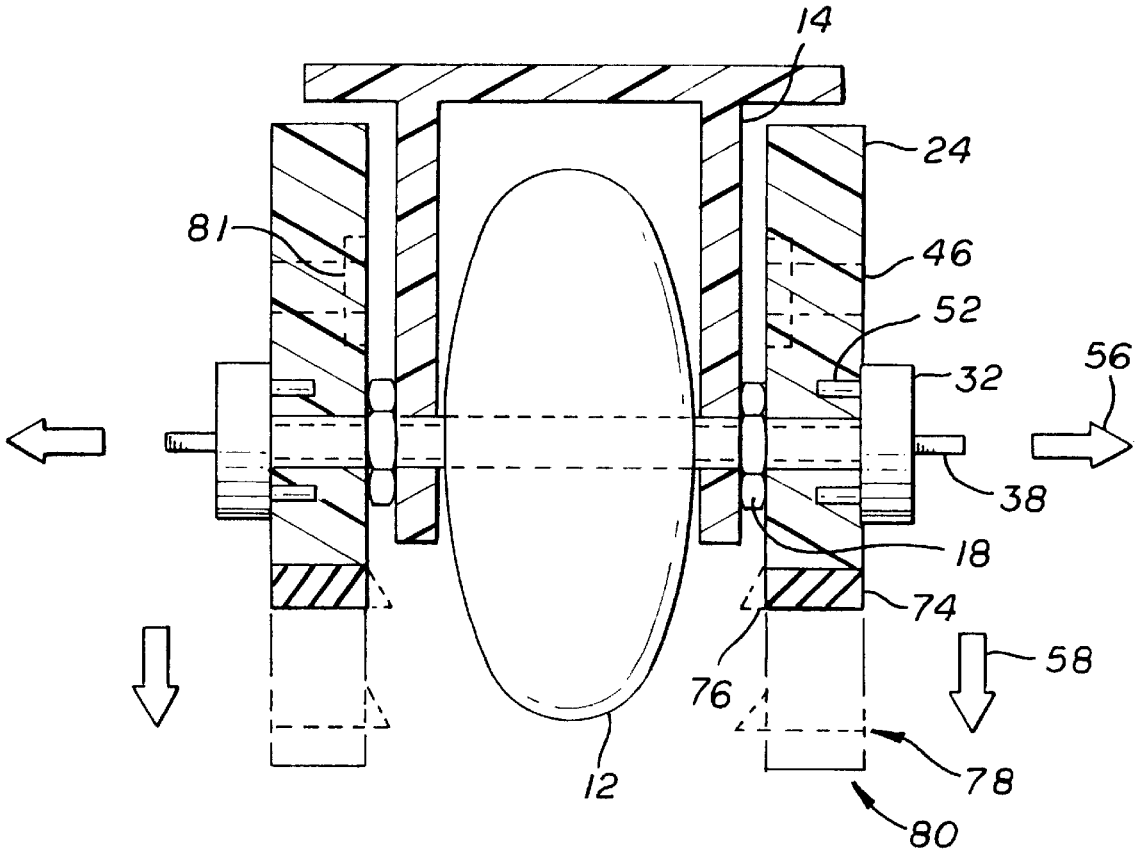
FIG. 5 is a partial cross-sectional view of another embodiment the present invention taken along the lines 3—3 of FIG. 2.

Referring to FIG. 5, FIG. 5 illustrates an alternative embodiment of the present invention in which the walking members are formed of straight vertical members as opposed to the arcuate members 24 illustrated in FIGS. 1–3. The embodiment illustrated in FIG. 5 works in a substantially similar fashion to that illustrated in FIGS. 1–3 with the exception of the ability to eliminate the spacer 22. In addition, the walking members 24 illustrated in FIG. 5 are provided with an alternative rubber strip 74 disposed along the ground-facing surfaces thereof. The rubber strip 74 may be provided with a flare 76 so as to provide an enhanced surface for the wearer to walk on. The rubber strip 74 may also be provided with a tread or textured surface to enhance traction. In addition, depending on the length of the transitional slots 50, the down position 44 of the walking members 24 illustrated in FIG. 5 can be either the position identified by reference numeral 78 which is substantially adjacent to the lower surface of the wheel 12 or a second position identified by the reference numeral 80 which is a position below the lower surface of the wheels 12.

In the position 80, the walking members 24 would support the entire weight of the wearer of the in-line skate boot 10, whereas in the position 78, it is possible that a portion of the weight of the wearer may be borne by the wheels 12, thus reducing the wear-and-tear on the walking members 24 and reducing the weight bearing strength required. It should be noted that in FIG. 3, the weight of the wearer is shared by the wheels 12 and the walking members 24, with the ends of the walking members 24 being formed so as to provide a large ground surface contact area for the walking members 24 and the wheels 12 to provide a stable walking surface for the wearer of the in-line skate illustrated in FIG. 1.

Additionally included in the embodiment shown in FIG. 5 are an optional pair of recesses 81 disposed on the inner wall surfaces of the walking members 24. The recesses 81 receive the respective nuts 18 therein when the walking members 24 are located in the down position 44. In this fashion, the walking members will be positioned in contact with the wheel support plates 14, thus adding to the structural rigidity of the present invention. The spring 54 is sufficiently strong to bias the walking members 24 against the wheel support plates 14. Further, in this position, it may be possible for the flared portion 76 of the rubber strip 74 to contact the wheels 12.

Figure 6:
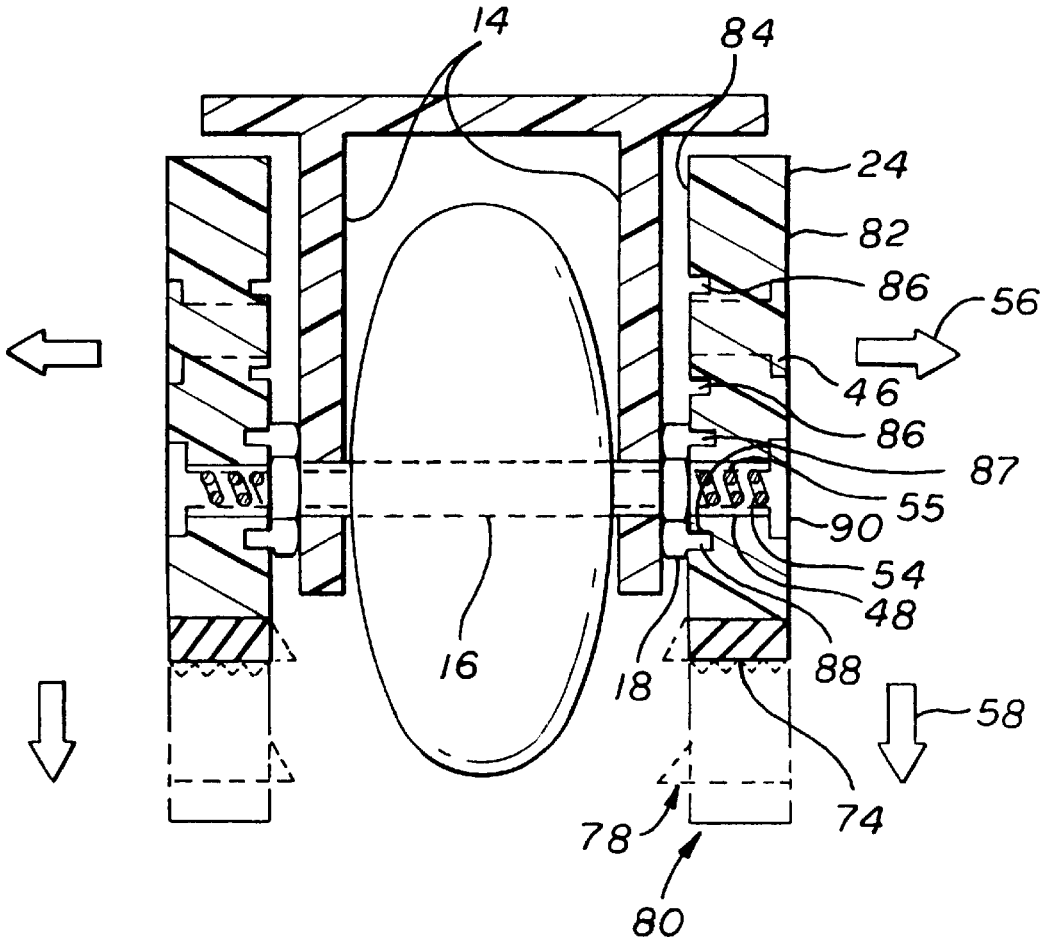
FIG. 6 is a further cross-sectional view taken along the lines 3—3 of FIG. 2 showing still another embodiment of the present invention.

FIG. 6 illustrates another embodiment of the present invention which eliminates the need for the walking member control knobs 32. Specifically, the walking members 24 illustrated in FIG. 6 have an outer wall surface 82 and an inner wall surface 84. The inner wall surface 84 of the walking members 24 are provided with a pair of upper locking pin receptacles 86 and a pair lower locking pin receptacles 87. The locking pin receptacles 86, 87 are provided to receive a corresponding pair of locking pins 88 which are disposed on the nuts 18 which is used to secure the bolts 16 to the wheel support plates 14. In this embodiment, a spring biased flat top 90 is provided for the bolt 16. A biasing force is provided by the spring 54 disposed in the spring channel 55 in fashion substantially similar to that seen in FIG. 3. In this embodiment, the flat top 90 of the bolt 16 allows the entire walking member 24 to be moved in the direction of the outward directional arrow 56. The walking member 24 is moved in the direction of the outward directional arrow 56 a sufficient distance to disengage the locking pins 88 from the locking pin receptacles 86 or 87. The walking member 24 is them moved so that the flat top 90 of the bolt 16 is slid along a channel formed in outer wall surface 82 of the walking member 24 from the lower bolt rest position 48 to the upper bolt rest position 46. Once the flat top 90 of the bolt 16 is positioned in the desired bolt rest position, 46 or 48, the wearer simply allows the biasing force of the spring 92 to pull the walking member 24 in a direction opposite to the outward directional arrow 56 thus causing the locking pins 88 to engage in the upper or lower locking pin receptacles 86, 87.

This embodiment eliminates the need for a connecting rod 36 between the walking member control knobs 32, thus eliminating the need for the wearer to operate a plurality of control knobs 32. This embodiment also contributes to the aerodynamic qualities of the in-line skates, incorporating the present invention. The wearer simply has to grasp a walking member 24, pull the walking member 24 in the direction of the outward directional arrow 56 and slide the walking member 24 to the desired up or down position, 42, 44. As with the embodiment seen in FIG. 5, depending upon the length of the transitional slot 50, the walking member 24 may be positioned in either of two down positions 78, 80.

While the above-discussed features of the present invention represent preferred embodiments of the present invention, it should be understood that the present invention is in no way limited to the features above described. For example, numerous modifications, additions and substitutions can be made to the above-described preferred embodiments of the present invention without departing from the spirit and scope of the present invention.

Specifically, numerous locking devices can be substituted for the devices illustrated in the figures to hold the bolt 16 in the upper or down position. Similarly, while the preferred embodiments illustrate nuts and spacers in association with the bolts which hold the wheels 12 in place on the skate 10, one skilled in the art would readily recognize that an integral bolting assembly could be formed which serves several functions, thus eliminating a need for separate parts. While the preferred embodiment utilizes injection molded plastic for the walking members described above, one skilled in the art would readily recognize that light weight aluminum, ceramic, polyvinylchloride (PVC), and other suitable materials could be substituted for the plastic of the present invention.

Similarly, while the preferred embodiments illustrate a pair of curved and straight walking members, one skilled in the art would readily recognize that it would be possible to incorporate different shapes for the walking members, or different combinations. For example, one curved and one straight walking member could be utilized, thus providing a stable walking platform while securing the wheels through the agency of the rubber strip disposed along the ground-facing edge of the curved walking member. Similarly, as FIG. 4 illustrates, a spring biasing force on the head of the bolt 16 is not necessarily required in order for the device of the present invention to operate. Further it is possible to utilize slots 30 having any desired shape including vertical. The present invention is not limited to the shape of the slots 30 shown in the drawings.

Through the above preferred embodiments, an in-line skate may be provided with a pair of walking members to allow the wearer thereof to walk in a substantially normal fashion while wearing the in-line skates, without fear of falling due to the rolling of the wheels. In addition to being manufactured for use with original equipment manufacture in-line skates, the present invention can easily be provided as an add-on device for existing in-line skates by replacing the current bolts holding the wheels to the wheel support plates and replacing them with the bolts sufficient to support the walking members illustrated in the figures above discussed. Lastly, while the bolts 16 in the figures appear to be of substantial length, one skilled in the art will readily recognize that the bolts 16 need only be of sufficient length to support the walking members thereon.

Figure 7:
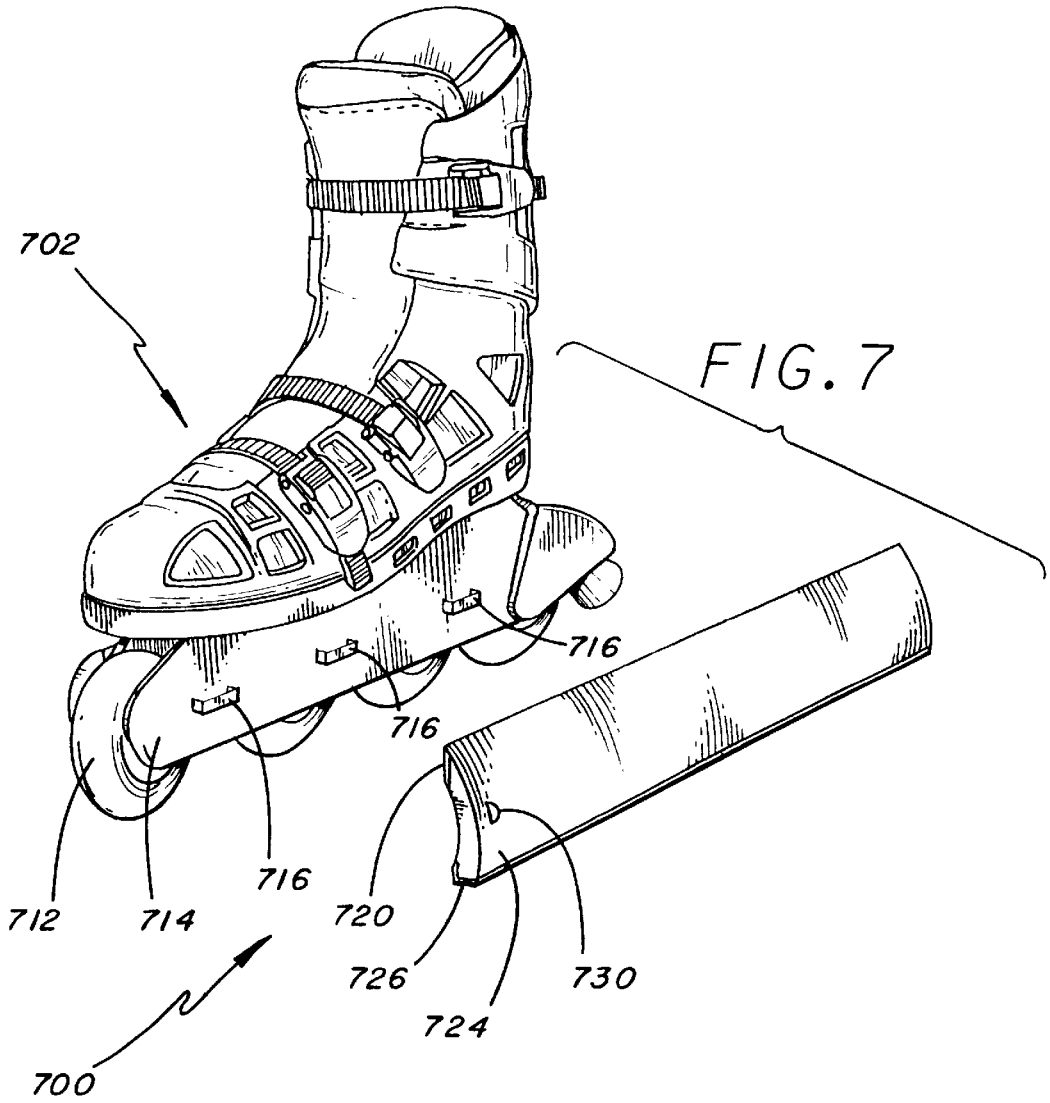
FIG. 7 is an exploded perspective view of a further embodiment of the present invention.
Figure 9:
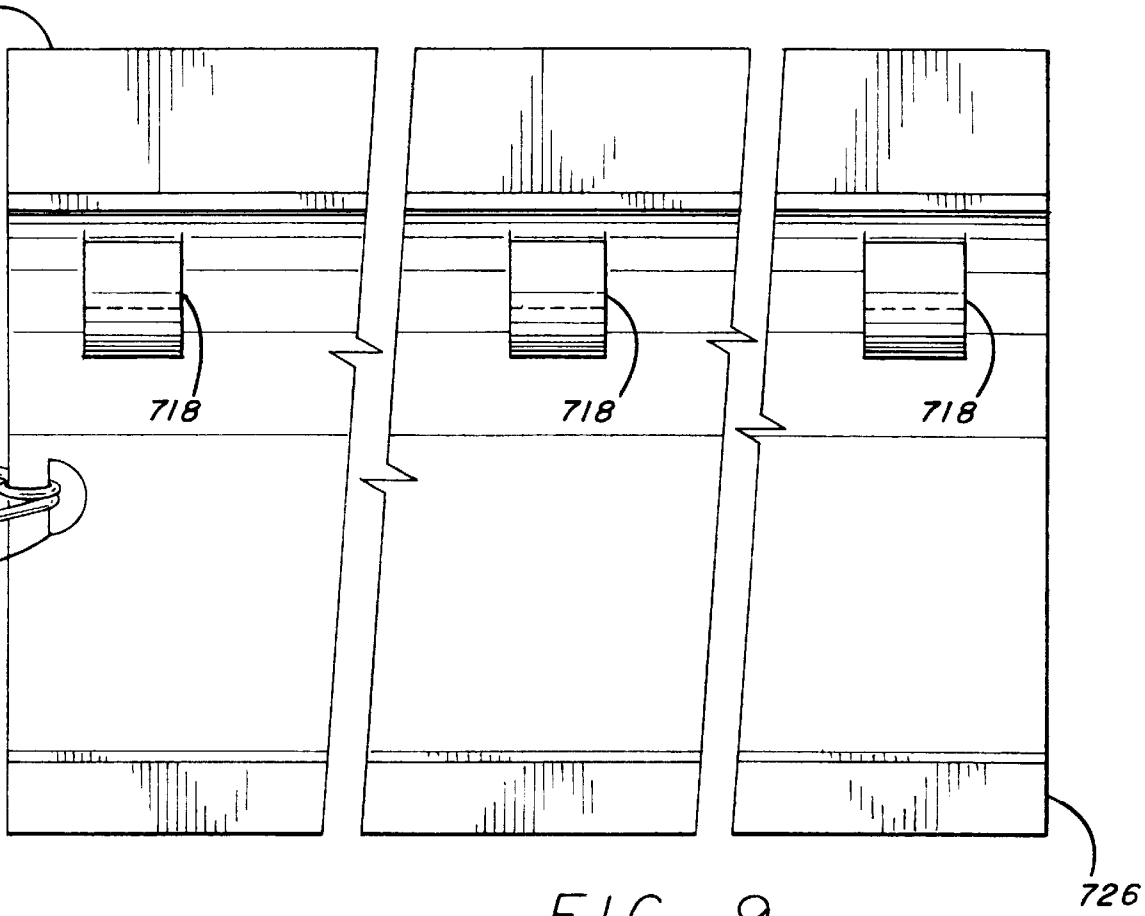
FIG. 9 is a side view of the detachable walking member of FIG. 8.

In a further embodiment of the present invention which incorporates all of the above features and advantages, the inventor has recognized that in certain situations the wearer of in-line skates may not desire to have walking members attached to the in-line skate at all times (whether in use or not). As such, the embodiment of the present invention illustrated in FIG. 7 provides an alternative to the embodiments of FIGS. 1–6, while still maintaining the attendant advantages thereof.

Referring to FIGS. 7–10, a detachable in-line skate conversion apparatus 700 is illustrated. The detachable in-line skate conversion apparatus incudes an in-line skate 702 having a plurality of wheels 712 and a wheel support member or plate 714 between which the wheels 712 are positioned as in the embodiment of the present invention described above. In the present embodiment, the support plate 714 is fitted with a series of loops or U-shaped support members 716. A plurality of walking members 724 are provided in a manner similar to the embodiment described above. In this embodiment, the walking members are provided with a series of hooks or tongues 718 disposed on the back surface thereof which detachably engage the support members 716. Thus, the walking members may be attached to and removed from the in-line skate as needed.

The walking members 724 are provided with a resilient member 720 along an upper surface thereof. The resilient member 720 provides a positive bias force away from the surface of the support plate 714, but the bias force may be overcome by application of sufficient force by the wearer. As such, the arrows 733 seen in FIG. 10 illustrate the motion capable by the walking member 724 relative to the support plate 714.

As in the embodiments described above, the walking members 724 are provided with a grip strip 726 to provide proper friction with the ground and against the wheels 712. While the grip strip 726 is preferably made of rubber, it may be made of any suitable material. In addition, a hole 730 is provided at one end of the walking members 724 to provide a suitable location to provide an attachment member to attach the walking members 724 to each other, as seen, for example, in FIG. 10. Any suitable cord 732 could be utilized for this purpose, including rubber, nylon, or any natural or synthetic material. The cord 732 may be sized to provide a further bias force across the front of the wheels 712 in a direction toward the viewer of FIG. 10.

Figure 8:
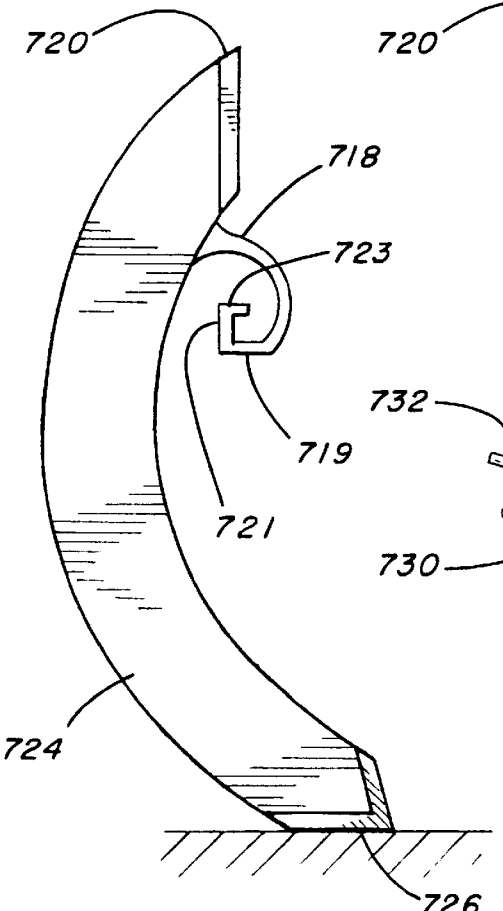
FIG. 8 is a front view of a detachable walking member in accordance with the embodiment of the invention of FIG. 7.
Figure 10:
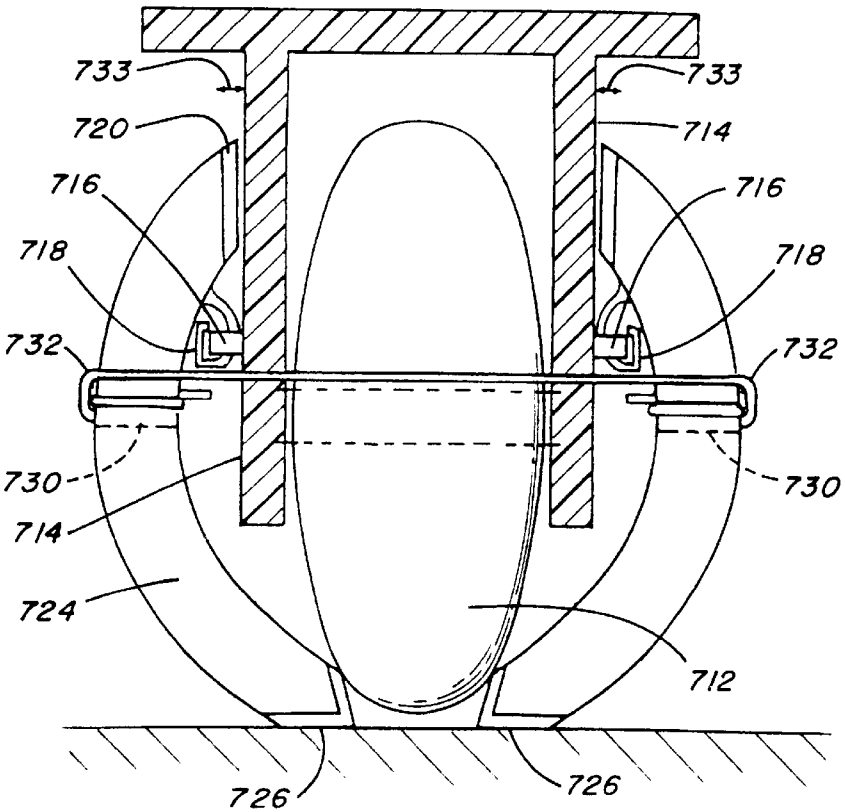
FIG. 10 is a partial front view of the embodiment of FIG. 7 showing the use of two detachable walking members in accordance with this embodiment.

Referring more particularly to FIGS. 8 and 10, the hooks or tongues 718 may be formed integral with the walking member 724 and include a flat portion 719, a vertical portion 721 and a second flat portion 723. The hook or tongues 718 may be made of any suitable material, for example, metal, plastic, ceramic or other material. The hooks may be formed integral with the walking member through an injection molding process or may be fastened to the walking member 724 by heat, adhesive, screws, bolts, rivets or any other suitable fastening method.

By providing the resilient member 720, it is possible to place the walking member up against the support member 714, then press to overcome the bias force provided by the resilient member 720, and thus insert the hook/tongue 718 through the loops 716. After insertion, the bias force ensures that the hook and loop 718 and 716 will remain engaged as the wearer walks. The second flat portion 723 is provided to engage the loop 716 and support the wearer as the wearer walks. In addition, the bias force produced by the resilient portion 720 produces a torque about the hook 718-loop 716 connections that pushes the grip strip 726 down towards the wheels 712 when the wearer picks up their foot. In addition to assisting in preventing the hook and loop connections from becoming disengaged, this also assists in preventing inadvertent spinning of the wheels 712.

Figure 11:
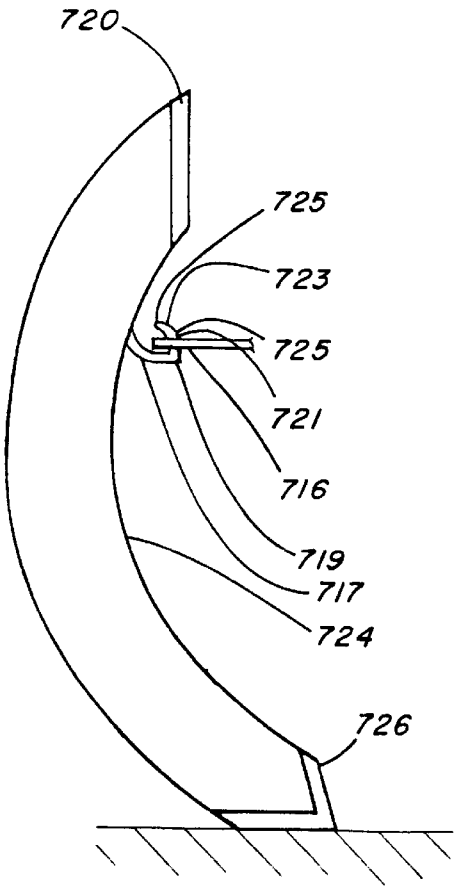
FIG. 11 is a front view of the detachable walking member of FIG. 8 using an alternative connection mechanism.
Figure 12:
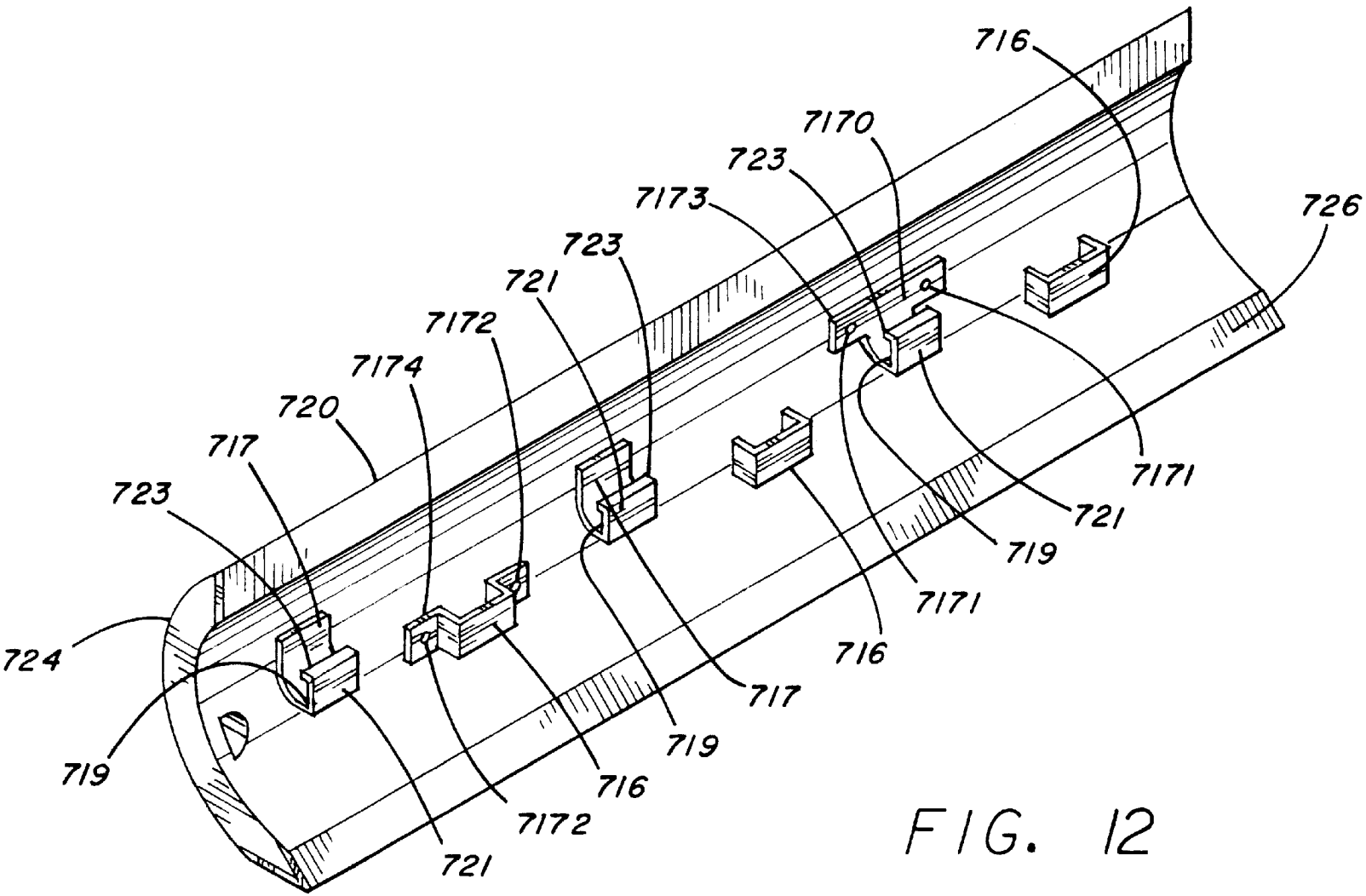
FIG. 12 is a perspective view of the walking member in accordance with another embodiment of the present invention.

In an alternative embodiment, as seen in FIGS. 11 and 12, the hook/tongue 717 is shaped so that the upper portion of the hook 717 is open. In this embodiment, the loops 716 will readily engage the upper flat portion 723 of the hook/tongue 717. As such, with the bias force of the resilient member 720 providing a proper bias of the loop 716 against the vertical portion 721 of the hook 717, the weight of the wearer will be properly supported.

In addition, the edges 725 of the hook 717, between the vertical portion 721 and the upper flat surface 723, are rounded to assist the wearer in installing and removing the walking members 724. The rounding of the hook member 717 may also be utilized in the previous embodiments and the invention is in no way limited to the shape of the hook illustrated in the drawings.

Figure 13:
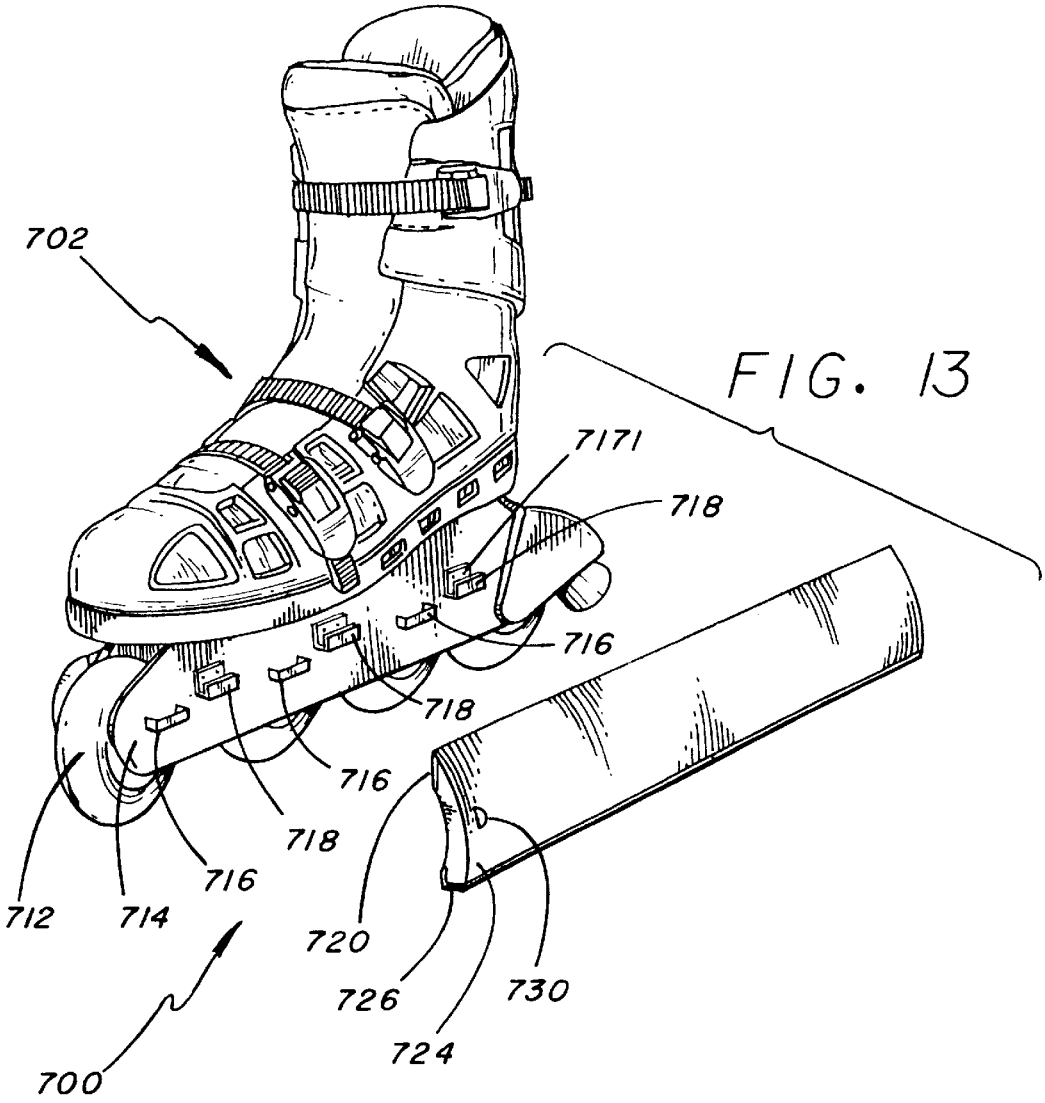
FIG. 13 is a perspective view of the in-line skate conversion apparatus in accordance with the embodiment of the invention illustrated in FIG. 12.

As seen in FIGS. 12 and 13, an alternative method for fastening the hooks or tongues 717 to the walking member 724 is illustrated. The hook or tongue 7170 is attached to the walking member 724 using fastening members 7171 that may be screws, rivets, bolts or any other suitable fastener. Alternatively, adhesive could be used in place of the fasteners or the flanged portions 7173 may be embedded in the material of the walking member 724. The other structure of the hook or tongue 7170 is the same as that seen in FIG. 11, including the flat portion 719, vertical portion 721 and second flat portion 723. The same fastening techniques can be used with the hook or tongues 718. As also seen in FIG. 12, the loops 716 may be provided with wings 7174 through which a rivet, screw or other fastening device 7172 is provided to secure the loop 716 to the walking member 724. As with the hook or tongue 7170, the wings 7174 may also be fastened to the walking member 724 using adhesive or may be embedded in the walking member 724.

As also illustrated in FIGS. 12 and 13, those skilled in the art will readily appreciate that this embodiment may be altered such that the hooks/tongues 718 are provided on the support member 714 (FIG. 13) while the loops 716 may be provided on the walking members 724 (FIG. 12). The combinations of hooks and loops may also be mixed as FIG. 12 illustrates to include both hooks and loops on the walking member 724 and the support member 714. In addition, any suitably shaped hook/loop members may be utilized, and the present invention is in no way limited to the illustrated hook and loop structure. In addition, as those skilled in the manufacturing arts will readily appreciate, the hook/loop connection mechanism may be provided on the in-line skates during the manufacture of the skate or may be added by the owner of the skate after the purchase of the skate.

In addition, while FIGS. 12 and 13 illustrate the use of both hooks and/or loops on the walking member 724, the invention is not limited to the use of hooks or loops. Any suitable number and combination of hooks and/or loops may be combined on both the walking member and in-line skate to assist in removably fastening the walking member to the in-line skate. In addition, as with the embodiments of FIGS. 1–6, the walking members 724 are not limited to the arcuate shape shown in the drawings but may also be flat, or any other suitable shape.

While the above discussion illustrates that numerous modifications, additions and substitutions can be made to the present invention without departing from the spirit and scope thereof, the invention is best defined by the claims which appear below:

What is claimed is:

1. An in-line skate system, comprising:

an in-line skate having a support member, a plurality of axles supported on the support member, a plurality of wheels respectively supported on the plurality of axles, and a plurality of skate fastener members secured to a portion of the in-line skate in spaced relation to the axles; and a walking member including a plurality of walking member fastener members;

the skate fastener members and walking member fastener members being respectively constructed and arranged such that the skate fastener members releasably interlock with the walking member fastener members to removably secure the walking member to the in-line skate.

2. An in-line skate system as claimed in claim 1, wherein the skate fastener members are secured to the support member.

3. An in-line skate system as claimed in claim 1, wherein the skate fastener members comprise a plurality of loops and the walking member fastener members comprise a plurality of hooks.

4. An in-line skate system as claimed in claim 1, wherein the skate fastener members comprise a plurality of hooks and the walking member fastener members comprise a plurality of loops.

5. An in-line skate system as claimed in claim 1, wherein the skate fastener members comprise at least a hook and a loop and the walking member fastener members comprise at least a hook and a loop.

6. An in-line skate system as claimed in claim 1, further comprising:

a resilient biasing device that maintains the skate fastener members and the walking member fastener members in an interlocked state.

7. An in-line skate system as claimed in claim 1, wherein the skate fastener members and the walking member fastener members are respectively constructed and arranged such that the walking member pivots about the skate fastener members and the walking member fastener members.

8. An in-line skate system as claimed in claim 7, further comprising:

a resilient biasing device associated with the walking member that biases the walking member about the skate fastener members and the walking member fastener members.

9. An in-line skate system, comprising:

an in-line skate having a support member, a plurality of axles supported on the support member, a plurality of wheels respectively supported on the plurality of axles, and a plurality of skate fastener members secured to a portion of the in-line skate in spaced relation to the axles;

a first walking member including a plurality of walking member fastener members; and a second walking member including a plurality of walking member fastener members;

the skate fastener members and walking member fastener members being respectively constructed and arranged such that the skate fastener members releasably interlock with the walking member fastener members to removably secure the first and second walking members to the in-line skate.

10. An in-line skate system as claimed in claim 9, wherein the skate fastener members are secured to the support member.

11. An in-line skate system as claimed in claim 9, wherein the skate fastener members comprise a plurality of loops and the walking member fastener members comprise a plurality of hooks.

12. An in-line skate system as claimed in claim 9, wherein the skate fastener members comprise a plurality of hooks and the walking member fastener members comprise a plurality of loops.

13. An in-line skate system as claimed in claim 9, wherein the skate fastener members comprise a hook and a loop and the walking member fastener members comprise a hook and a loop.

14. An in-line skate system as claimed in claim 9, further comprising:

a first resilient biasing device that maintains the skate fastener members and the walking member fastener members associated with the first walking member in an interlocked state; and a second resilient biasing device that maintains the skate fastener members and the walking member fastener members associated with the second walking member in an interlocked state.

15. An in-line skate system as claimed in claim 9, wherein the skate fastener members and walking member fastener members are respectively constructed and arranged such that the first walking member pivots about the skate fastener members and the walking member fastener members associated therewith and the second walking member pivots about the skate fastener members and the walking member fastener members associated therewith.

16. An in-line skate system as claimed in claim 15, further comprising:

a first resilient biasing device that pivots the first walking member about the skate fastener members and the walking member fastener members associated therewith; and a second resilient biasing device that pivots the second walking member about the skate fastener members and the walking member fastener members associated therewith.

17. An in-line skate system as claimed in claim 9, further comprising:

a fastener mechanism that fastens the first walking member to the second walking member.

18. An in-line skate system, comprising:

an in-line skate having a plurality of axles, a support member through which the axles extend, a plurality of wheels respectively supported on the plurality of axles, and a support member fastener secured to the support member; and a walking member including a walking member fastener;

the support member fastener and the walking member fastener being respectively constructed and arranged such that the support member fastener releasably interlocks with the walking member fastener to removably secure the walking member to the support member.

19. An in-line skate system as claimed in claim 18, wherein the support member includes a laterally facing surface and the support member fastener extends outwardly from the laterally facing surface.

20. An in-line skate system as claimed in claim 18, wherein the support member fastener comprises a plurality of support member fastener members and the walking member fastener comprises a plurality of walking member fastener members.

21. An in-line skate system as claimed in claim 20, wherein at least one of the support member fastener members and the walking member fastener members comprises a hook and at least one the support member fastener members and the walking member fastener members comprises a loop.

22. An in-line skate system as claimed in claim 18, wherein the support member comprises a plate.

23. An in-line skate system as claimed in claim 18, wherein the first and second support member fasteners and the first and second walking member fasteners are respectively constructed and arranged such that the first walking member pivots about the first support member fastener and the first walking member fastener and the second walking member pivots about the second support member fastener and the second walking member fastener.

24. An in-line skate system as claimed in claim 23, further comprising:

a first resilient biasing device that pivots the first walking member about the skate fastener members and the walking member fastener members associated therewith; and a second resilient biasing device that pivots the second walking member about the skate fastener members and the walking member fastener members associated therewith.

25. An in-line skate system as claimed in claim 18, wherein the support member comprises a pair of support member portions and at least one of the wheels is located between the support member portions.

26. An in-line skate system as claimed in claim 18, wherein the support member fastener is located adjacent to the axles.

27. An in-line skate system, comprising:

an in-line skate having a support member, a plurality of axles supported on the support member, a plurality of wheels respectively supported on the plurality of axles, and a support member fastener secured to the support member;

a walking member including a walking member fastener;

the support member fastener and the walking member fastener being respectively constructed and arranged such that the support member fastener releasably interlocks with the walking member fastener to removably secure the walking member to the support member; and a resilient biasing device that maintains the support member fastener and the walking member fastener in an interlocked state.

28. An in-line skate system, comprising:

an in-line skate having a support member, a plurality of axles supported on the support member, a plurality of wheels respectively supported on the plurality of axles, and a support member fastener secured to the support member; and a walking member including a walking member fastener;

the support member fastener and the walking member fastener being respectively constructed and arranged such that the walking member pivots about the support member fastener and the walking member fastener, and the support member fastener releasably interlocks with the walking member fastener to removably secure the walking member to the support member.

29. An in-line skate system as claimed in claim 28, further comprising:

a resilient biasing device associated with the walking member that biases the walking member about the support member fastener and the walking member fastener.

30. An in-line skate system, comprising:

an in-line skate having first and second support members, a plurality of axles extending between the first and second support members, a plurality of wheels respectively supported on the plurality of axles between the first and second support members, a first support member fastener secured to the first support member and a second support member fastener secured to the second support member;

a first walking member including a first walking member fastener, the first walking member fastener and the first support member fastener being respectively constructed and arranged such that the first walking member fastener releasably interlocks with the first support member fastener to removably secure the first walking member to the first support member; and a second walking member including a second walking member fastener, the second walking member fastener and the second support member fastener being respectively constructed and arranged such that the second walking member fastener releasably interlocks with the second support member fastener to removably secure the second walking member to the second support member.

31. An in-line skate system as claimed in claim 30, wherein the first and second support members comprise first and second plates.

32. An in-line skate system as claimed in claim 30, wherein the first and second support members respectively include first and second laterally facing surfaces, the first support member fastener extends outwardly from the first laterally facing surface, and the second support member fastener extends outwardly from the second laterally facing surface.

33. An in-line skate system as claimed in claim 30, wherein the first and second support member fasters each comprise a plurality of support member fastener members and the first and second walking member fasteners each comprise a plurality of walking member fastener members.

34. An in-line skate system as claimed in claim 33, wherein at least one of the support member fastener members and the walking member fastener members comprises a hook and at least one the support member fastener members and the walking member fastener members comprises a loop.

35. An in-line skate system as claimed in claim 30, further comprising:

a first resilient biasing device that maintains the first support member fastener and the first walking member fastener in an interlocked state; and a second resilient biasing device that maintains the second support member fastener and the second walking member fastener in an interlocked state.

* * * * *